US008325103B2

(12) United States Patent
Autti

(10) Patent No.: US 8,325,103 B2
(45) Date of Patent: Dec. 4, 2012

(54) ANTENNA ARRANGEMENT

(75) Inventor: Marko Tapio Autti, Oulu (FI)

(73) Assignee: Nokia Corporation, Espoo (FI)

( * ) Notice: Subject to any disclaimer, the term of this patent is extended or adjusted under 35 U.S.C. 154(b) by 266 days.

(21) Appl. No.: 12/775,653

(22) Filed: May 7, 2010

(65) Prior Publication Data

US 2011/0273361 A1 Nov. 10, 2011

(51) Int. Cl.
*H01Q 1/00* (2006.01)
*H01Q 1/24* (2006.01)

(52) U.S. Cl. ..... 343/904; 343/702

(58) Field of Classification Search ..... 343/904, 343/702, 700 MS, 846, 848
See application file for complete search history.

(56) References Cited

U.S. PATENT DOCUMENTS

| | | | | |
|---|---|---|---|---|
| 5,359,340 | A | 10/1994 | Yokota | 343/792 |
| 6,765,536 | B2 | 7/2004 | Phillips et al. | 343/702 |
| 7,061,440 | B2 | 6/2006 | Choo et al. | 343/728 |
| 8,170,522 | B2 * | 5/2012 | Guan et al. | 455/330 |
| 2003/0098812 | A1 * | 5/2003 | Ying et al. | 343/702 |
| 2007/0285321 | A1 | 12/2007 | Chung et al. | 343/702 |
| 2009/0058735 | A1 | 3/2009 | Hill et al. | 343/702 |

FOREIGN PATENT DOCUMENTS

| | | | |
|---|---|---|---|
| EP | 0 747 990 | A1 | 12/1996 |
| EP | 1 109 251 | A2 | 6/2001 |
| EP | 1 318 567 | A1 | 12/2002 |
| EP | 1 383 198 | A1 | 1/2004 |
| EP | 1 594 185 | A1 | 2/2005 |
| EP | 1 231 674 | B1 | 3/2008 |
| WO | WO 96/41397 | | 12/1996 |

OTHER PUBLICATIONS

"A Top-Loaded, Inductively-Coupled Small Antenna for HF Ground Wave Transmission", S.Lim et al, vol. 3; (Jun. 20-25, 2004), pp. 3187-3190.

"A Feeding Method for Small Helical Antennas" Nozomu Hasebe, vol. 90; (Nov. 15, 2006), pp. 33-41.

* cited by examiner

*Primary Examiner* — Hoanganh Le
(74) *Attorney, Agent, or Firm* — Harrington & Smith

(57) ABSTRACT

An apparatus such as for example an antenna sub-assembly includes a multiband antenna circuitry and feed circuitry. The multiband antenna circuitry includes a resonator; a first ground port configured to couple the resonator to a common voltage potential; and at least one reactive component disposed between the resonator and the first ground port. The feed circuitry includes: a signal feed port configured to couple to a radio; a second ground port configured to couple the feed circuitry to the common voltage potential; and a feeding element disposed between the signal feed port and the second ground port, the feeding element configured to inductively couple the feed circuitry to the antenna circuitry between the resonator and the first ground port. In some example embodiments there is a variable reactance to enable the resonator to be tunable. In those and/or other embodiments there is a second and even a third resonator for multi-band operation.

18 Claims, 6 Drawing Sheets

ANTENNA ARRANGEMENT

TECHNICAL FIELD

The example and non-limiting embodiments of this invention relate generally to wireless communication systems, methods, devices and computer programs and, more specifically, relate to a radio antenna and related feeding arrangement.

BACKGROUND

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Increasingly, mobile radio handsets incorporate one or multiple radios that operate over different protocols and different frequency bands. This is true over multiple cellular band as with tri and quad-band mobile devices that operate in several cellular systems such as GSM (global system for mobile communications, or 3G), UTRAN (universal mobile telecommunications system terrestrial radio access network, or 3.5G), WCDMA (wideband code division multiple access), and OFDMA (orthogonal frequency division multiple access), to name but a few examples. Additionally, many handsets come equipped with secondary radios such a global positioning system GPS, Bluetooth, wireless local area network WLAN, and/or traditional FM radio that operate alongside the cellular band radios.

Simultaneous with this desire for communication over diverse frequency bands is the continued preference of ever smaller handsets. This creates several technological challenges, not least of which is design and placement of antennas for such varied bands in the small and crowded handset in a manner that generally assures reliable signal transmission and reception without excessive interference with or from other electronics within that same handset housing.

This is a challenging environment for the antenna designer. There are quite strict requirements for several operating bands, and the small antenna volumes available within the handset impose conflicting constraints. Especially cellular bands are very difficult to cover with a single resonance and so require either multiple antennas or tunable antennas. This readily leads to complicated matching topologies, adding to the designer's burden of simultations and difficulty in finding an operable solution.

SUMMARY

In a first aspect thereof the exemplary embodiments of this invention provide an apparatus comprising multiband antenna circuitry and feed circuitry. The multiband antenna circuitry comprises: a resonator; a first ground port configured to couple the resonator to a common voltage potential; and at least one reactive component disposed between the resonator and the first ground port. The feed circuitry comprises: a signal feed port configured to couple to a radio; a second ground port configured to couple the feed circuitry to the common voltage potential; and a feeding element disposed between the signal feed port and the second ground port, the feeding element configured to inductively couple the feed circuitry to the antenna circuitry between the resonator and the first ground port.

In a second aspect thereof the exemplary embodiments of this invention provide an apparatus comprising multiband antenna circuitry and feed circuitry. The multiband antenna circuitry comprises: resonating means; first grounding means; and electrical length extending means between the resonating means and the first grounding means. The feed circuitry comprises: radio coupling means; second grounding means; and induction means between the radio coupling means and the second grounding means for inductively passing electrical signals between the feed circuitry and the antenna circuitry between the resonating means and the first grounding means.

In a third aspect thereof the exemplary embodiments of this invention provide a method comprising: transmitting a first signal at a first frequency through an antenna arrangement by driving the signal from a feed port to a resonator via an inductive coupling disposed between a coil and a ground port, in which the first signal passes through the coil prior to transmission from the resonator; and transmitting a second signal at a second frequency through the antenna arrangement by driving the signal from the feed point.

These and other aspects are detailed with greater particularity below.

DETAILED DESCRIPTION

Figure 3:
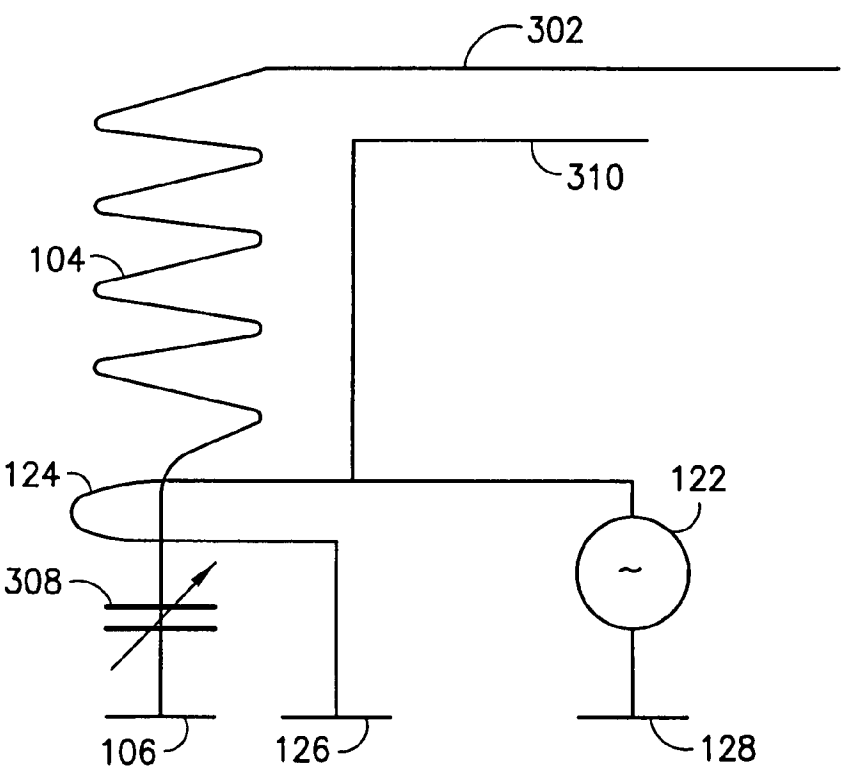
Figure 5:
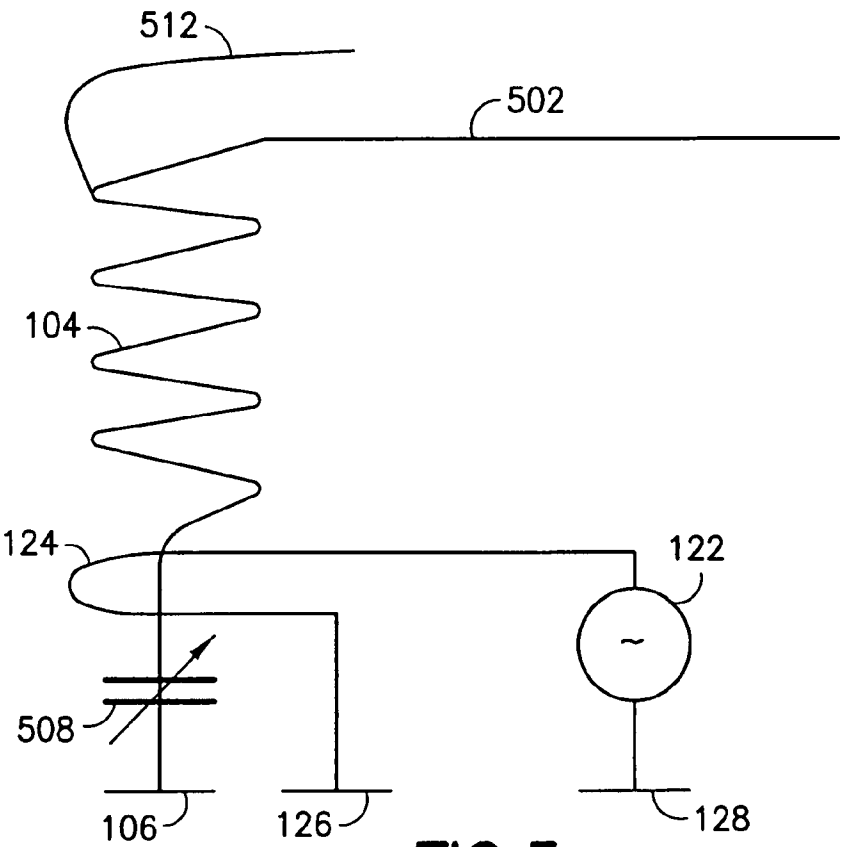
Figure 4:
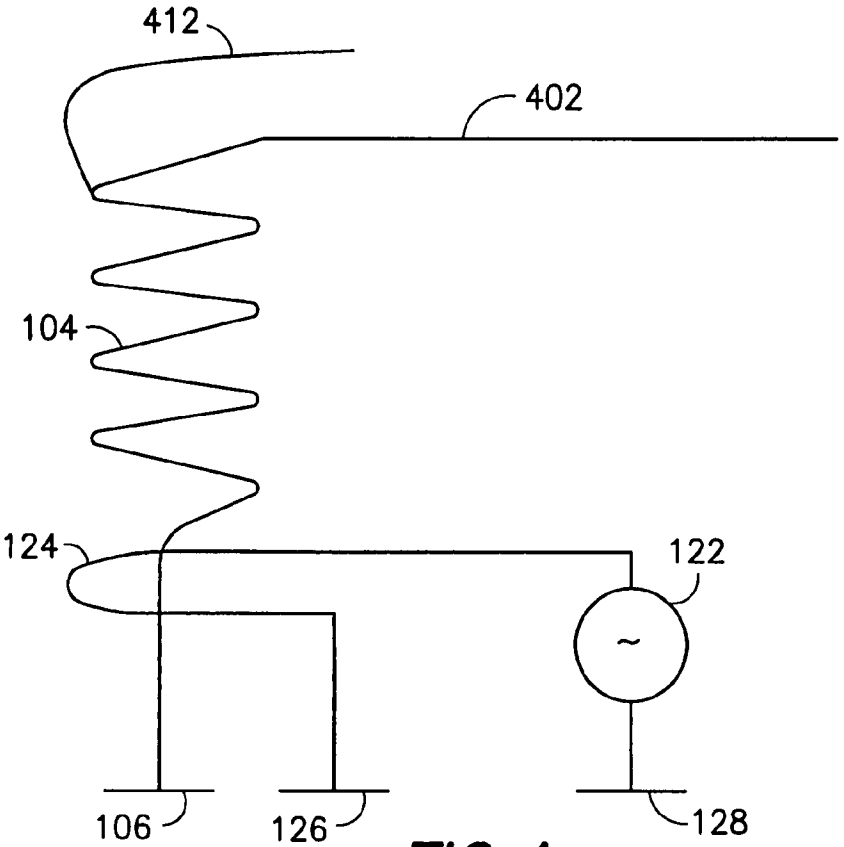
Figure 7:
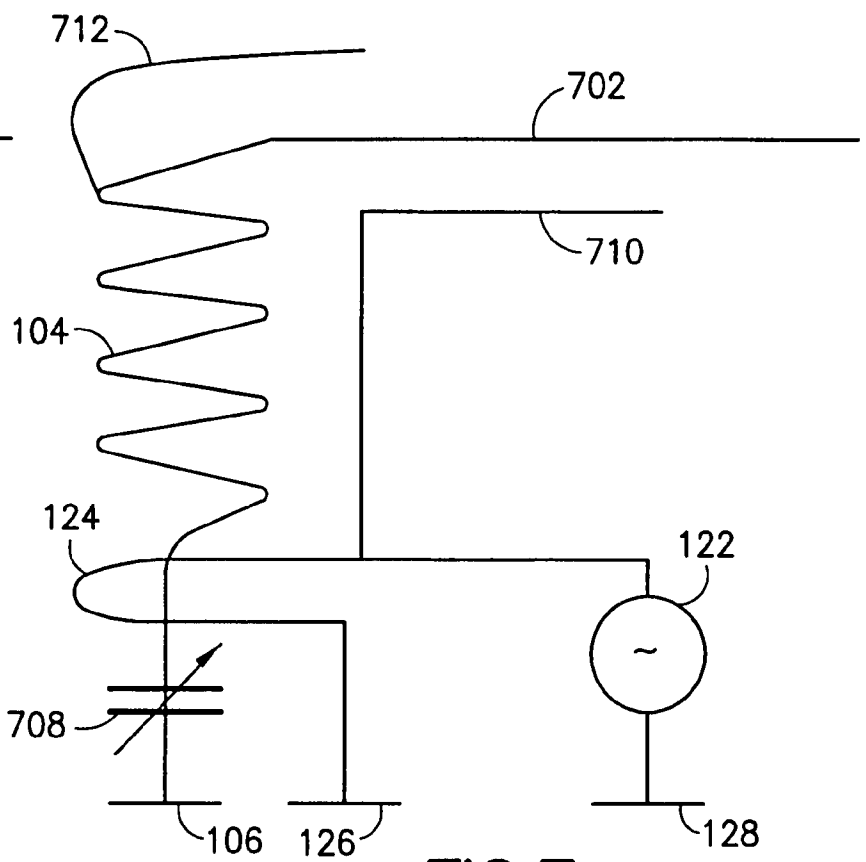
Figure 6:
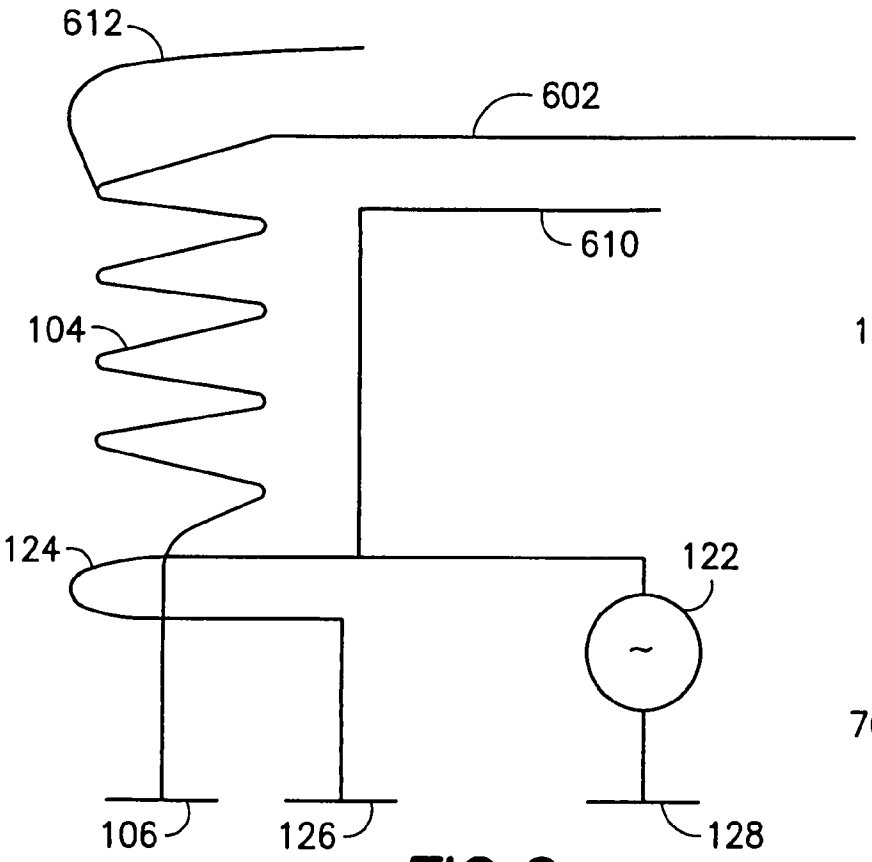

FIGS. 1-7 illustrate schematically seven distinct example embodiments of the invention. FIGS. 3, 5 and 7 are variants of FIG. 1; FIGS. 4 and 6 are variants of FIG. 2. It will be evident by those skilled in the RF antenna arts that various combinations may be formed utilizing individual components from various diverse ones of these illustrations. Such combinations remain within the scope of these teachings, and to the extent not excluded by specific claim language are also within the scope of some claims presented below, even if not explicitly detailed in text or drawing in all particulars of such various combinations of elements.

Each of FIGS. 1-7 are described as a combination of an antenna resonant circuit or circuitry and a feed circuit or circuitry. These terms do not mandate components that are mutually exclusive, for example a second resonator at FIGS. 2-3 and 6-7 couples to the feed circuitry though being a resonator it is functionally aligned with the antenna circuitry. The antenna circuitry is multi-band in that it is configured to resonate in more than one radio frequency band, such bands being distinguished from one another in that they are non-contiguous in the frequency domain.

Figure 1:
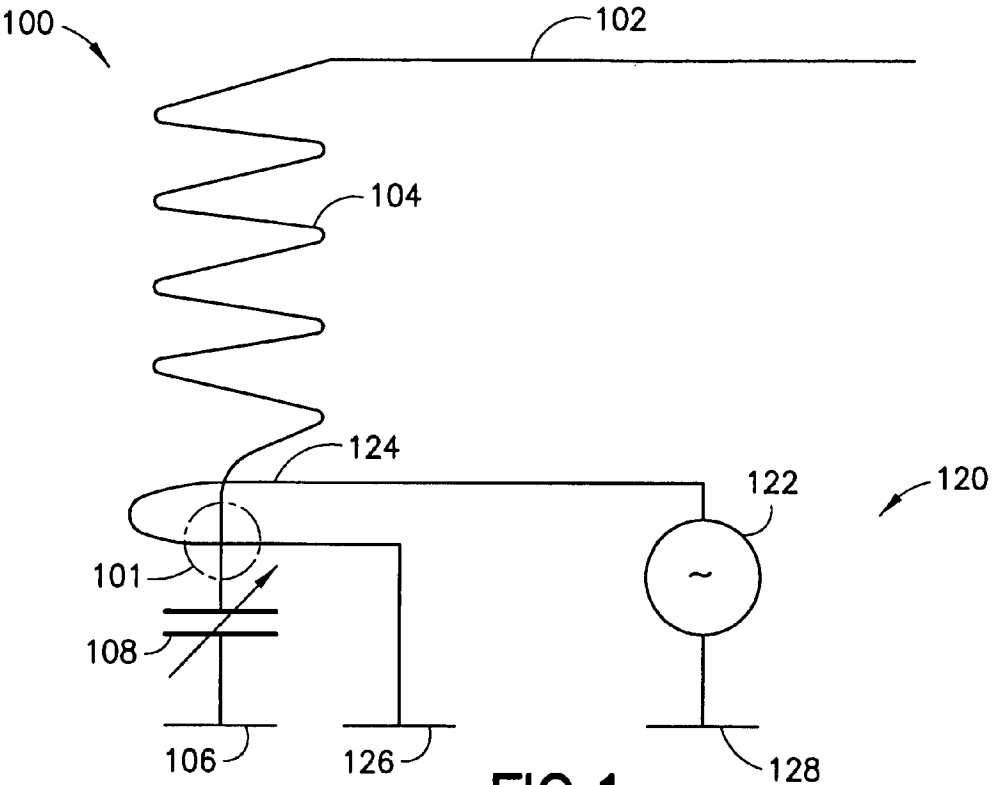
FIGS. 1-7 are schematic diagrams illustrating respective first through seventh exemplary embodiments of the invention.

At FIG. 1 there is a multiband antenna circuitry 100 which includes a resonator 102, a first ground port 106 for coupling the resonator to a common voltage potential such as a ground plane, at least one reactive component 104 that is disposed between the resonator 102 and the first ground port 106, and a variable reactance 108 disposed between the reactive component 104 and the first ground port 106.

In some exemplary but non-limiting embodiments, the resonator 102 may be a planar radiating element; and/or the reactive component 104 may be a coil or winding which extends the effective electrical length of the antenna circuitry 100 between the area of inductive coupling and the resonator 102; and/or the variable reactance 108 may be a variable capacitor or a variable inductor or multiple such components. The variable reactance enables the resonator 102 to operate at a tunable resonance, and therefore operate as a multiband antenna.

Further at FIG. 1, the feed circuitry 120 includes a signal feed port 122 for coupling to at least one radio (either transmitter, receiver or transceiver), a second ground port 126 for coupling the feed circuitry 120 to the common voltage potential or ground plane, and an inductive feeding element 124 disposed between the feed port 122 and the second ground port 126. The feeding element 124 inductively couples the feed circuitry 120 to the antenna circuitry 100, at a point or area between the resonator 102 and the first ground port 106 and more particularly between the reactive component 104 and the variable reactance 108. The feed circuitry 120 also includes a third ground port 128 for coupling the feed circuitry 120 to the common voltage potential or ground plane. As shown at FIG. 1, the third ground port 128 is disposed such that the signal feed port 122 is disposed between the feeding element 124 and the third ground port 128.

In some example embodiments, the feeding element 124 is one or more loops of conductive wire or trace that substantially surround a section 101 of the antenna circuitry between the fixed reactive component or coil 104 and the variable reactance 108. In some example embodiments there may be a plurality of such loops forming a helix, which may run at least partly alongside the coils of the fixed reactive component 104. There may be a gap formed between the section 101 of the antenna circuitry mentioned above and the inductive feeding element 124, this gap may be an air gap or it may be filled with material suitable for efficient electromagnetic coupling between the section 101 of antenna circuitry and the inductive feeding element 124. The gap may therefore have material properties such as dielectric constant and loss tangent which provide the required coupling and minimize any RF losses in the coupling structure. When the gap is filled with a material, the material may additionally provide mechanical support to the coupling structure such that the amount of coupling with respect to frequency may be closely controlled.

Certain elements of FIG. 1, and of FIGS. 2-7 below, are described as ports. The invention may be embodied as an apparatus that is a sub-assembly for incorporation into an overall host device such as for example a mobile handset or other such mobile user equipment. That is, embodiments of the invention may be practiced even before the exemplary circuitry 100, 120 shown herein is physically interfaced to a ground plane at ports 106, 126 and 128, and/or to a radio at ports 122. Such physical interfacing is often done only at final assembly of the host device.

Note particularly the electrical arrangement of the resonator 102 with respect to the first ground port 106 in relation to the inductive feeding element 124. It is at this feeding element 124 that the radio signal, originating from a radio transmitter coupled at the feed port 122, is passed from the feed circuitry 120 to the resonator 102 for transmission. In the opposite signal direction a signal received at the resonator 102 is passed from the antenna circuitry 100 to the feed circuitry 120 at the inductive feeding element 124, and thereafter output at the feed port 122 to a radio receiver. This arrangement is an electrically shorted antenna; in other words there is a ground coupling at the first ground port 106 separate from the signal feed to the resonator 102 which is provided inductively at the feeding element 124. All embodiments shown at FIGS. 1-7 have such a shorted arrangement for all of the illustrated resonators.

Figure 2:
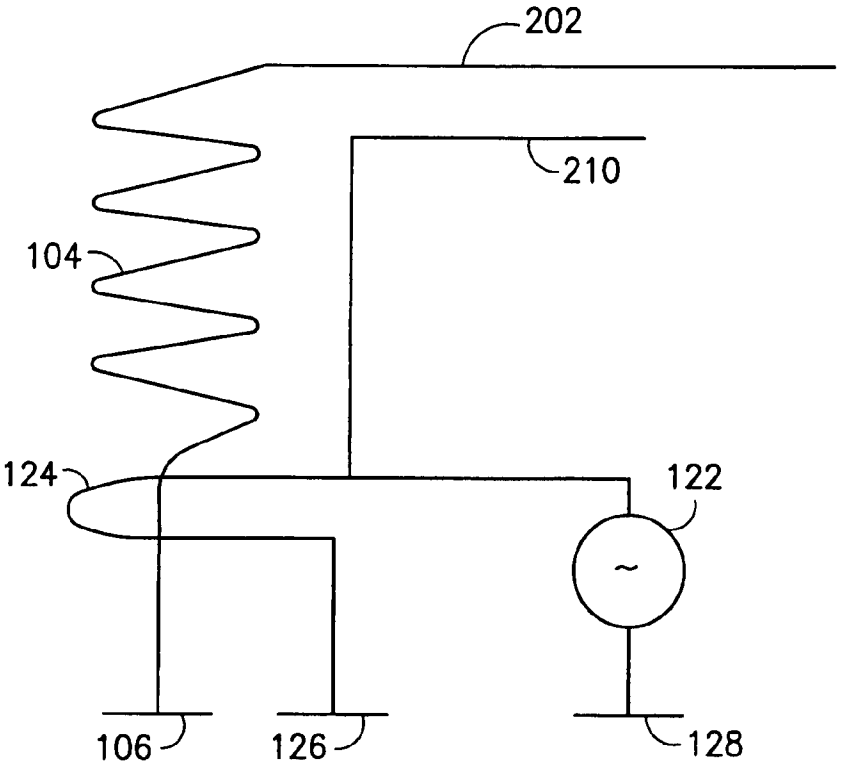

For the illustrations at FIGS. 2-7, like reference numbers indicate similar components as were described for FIG. 1, and so are not further detailed separately. FIG. 2 differs in at least two respects from FIG. 1: FIG. 2 lacks the variable reactance 108 described for FIG. 1, and FIG. 2 includes a second resonator 210 which is coupled to the feed circuitry 120 between the feeding element 124 and the signal feed port 122. To keep antenna radiator elements distinct, there is also shown at FIG. 2 a first resonator 202. In the embodiment of FIG. 2, both the first 202 and second 210 resonators are of fixed resonance since there is no variable reactance in the FIG. 2 embodiment. These resonators 202, 210 therefore operate only in one contiguous frequency band (though such a contiguous band may be broad enough to span multiple cellular bands).

The FIG. 3 example embodiment is similar to that of FIG. 2, except it can be seen that FIG. 3 does include a variable reactance 308. Due to the configuration of the two different resonators, the first resonator 302 is tunable by the variable reactance 308 and the second resonator 310 exhibits a fixed resonance. Tuning the variable reactance 308 generally will have a negligible effect on the resonance of the second resonator 310.

FIG. 4 is similar in many respects to FIG. 2; it lacks the variable reactance 108, 308 described for FIGS. 1 and 3, and like FIG. 2 there is in FIG. 4 a first resonator 402 and a second resonator 412, but in the FIG. 4 example embodiment the second resonator 412 is coupled to the reactive component 104 in electrical parallel with the first resonator 402. In the specific embodiment of FIG. 4, both resonators are planar and both are of fixed resonance.

FIG. 5 is similar in some respects to FIG. 3; it includes a similarly positioned variable reactance 508 and so the first resonator 502 is tunable as is the first resonator 302 of FIG. 3. But like FIG. 4, the second resonator 512 of FIG. 5 is coupled to the reactive component 104 in electrical parallel with the first resonator 502. Due to the presence of the variable reactance 508, then unlike FIG. 4 the second resonator 512 in FIG. 5 is tunable and multiband.

The example embodiment of FIG. 6 may be considered a combination of FIGS. 2 and 4. There is a notable lack of any variable reactance and so all resonators in FIG. 6 are of fixed resonance and not tunable. There is in FIG. 6 a first resonator 602 coupled to the reactive component 104, and like FIG. 2 a second resonator 610 coupled to the feed circuitry 120 between the feeding element 124 and the signal feed port 122, and like FIG. 4 there is additionally another (third) resonator 612 coupled to the reactive component 104 and in electrical parallel with the first resonator 602. In this example embodiment all three of these resonators 602, 610 and 612 are planar. In other example embodiments one or more of those three resonators 602, 610 and 612 are non-planar.

The example embodiment of FIG. 7 is similar to that of FIG. 6, but including a variable reactance 708 in the position similar to that detailed with respect to FIG. 1. FIG. 7 includes a first resonator 702 coupled to the reactive component 104, a second resonator 710 coupled to the feed circuitry 120 between the feeding element 124 and the signal feed port 122, and a third resonator 712 coupled to the reactive component 104 and in electrical parallel with the first resonator 702. Like FIG. 6 in some example embodiments all three of these resonators are planar. But unlike FIG. 6, the antenna circuitry 100 of FIG. 7 includes the variable reactance 708, enabling both the first resonator 702 and the third resonator 712 to be tunable while the second resonator 710 remains fixed band.

In the above example embodiments any one or more of the resonators 102, 202, 210, 302, 310 402, 412, 502, 512, 602, 610, 612, 702, 710 and 712 may be considered as example embodiments of resonating means; any one or more of the ground ports 106, 126 and 128 may be considered as example embodiments of grounding means; and the various implementations (coil, helix, loop) of the reactive component 104 may be considered example embodiments of electrical length extending means. The exemplary variable capacitor(s) and variable inductor(s) are embodiments of variable reactance means, which enables a tunable resonance for one or more of the resonating means.

Further, the feed port 122 may be considered as an example embodiment of radio coupling means; and the feeding element may be considered as example embodiments of induction means for inductively passing electrical signals between the feed circuitry and the antenna circuitry.

In operation, the antenna radiator or resonator 102, 202, 302, 402, 502, 602, 702 which may be planar or non-planar, is electrically short with respect to a resonant wavelength and is inductively fed via the feeding element 124. This radiator or resonator is also electrically loaded by the reactive component 104, which is functionally an electrical lengthening reactive component or antenna loading reactance (that may be embodied as a coil or helix to name a few non-limiting examples) between the antenna and the feed location at the feeding element 124. The feeding element 124 is configured to electromagnetically couple to a radio circuit (which couples in at the feed port 124) and is located between the first ground port 106 and the antenna resonator 102. Since the antenna is shorted, the variable reactive element 108 is coupled to a ground plane of the antenna. Due to its physical location in the illustrated examples, the inductive feed element 124 also operates as an antenna loading element. Note that in the illustrated example tunable embodiments the variable capacitance or inductance 108 lies on the antenna side of the inductive feed arrangement, in other words the variable reactance 108 is galvanically isolated from the feed port 122.

Additionally, in all illustrated example embodiments the secondary coil 104 serves the dual function of shortening the electrical length of the antenna and also serving as a part of the feed arrangement. Note that the location of the feed point, at which a signal is transferred between the feed circuitry 120 and the antenna circuitry 100, may be disposed anywhere between the variable reactance 108 and the resonator 102. In some exemplary embodiments the coil 104 extends the entire length between those two elements 102, 108 and so the feeding element 124 may be co-axial about the coil 104 itself. In other exemplary embodiments there is a non-coil segment of wire between the coil 104 and the variable reactance 108 (or between the coil 104 and the resonator 102) in which case the feeding element 124 may be co-axial about that non-coil segment of the wire or co-axial about the coil 104 or co-axial about a combination of the two.

In some example embodiments the technical effect of the invention is a smaller antenna volume, good antenna radio frequency radiation efficiency performance, and in some example tunable embodiments the ability to easily tune antenna across a wide bandwidth.

Figure 8:
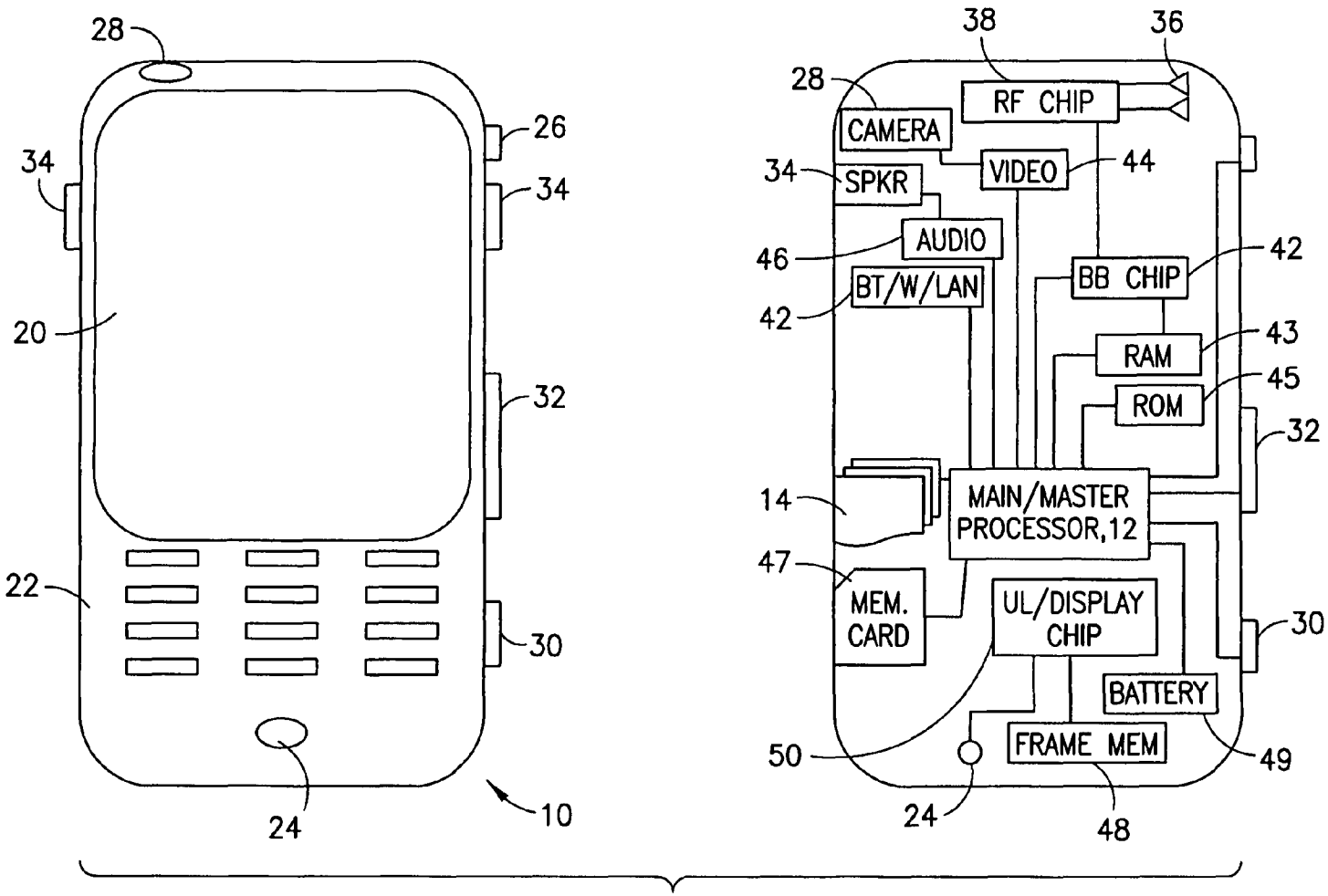
FIG. 8 is a schematic diagram in plan view (left) and sectional view (right) of a mobile handset according to an example embodiment of the invention.

A multiband antenna 100 according to the example embodiments may be disposed in a mobile station 10 such as the one shown at FIG. 8, also termed a user equipment (UE) 10. In general, the various example embodiments of the UE 10 can include, but are not limited to, cellular telephones, personal digital assistants (PDAs) having wireless communication capabilities, portable computers having wireless communication capabilities, image capture devices such as digital cameras having wireless communication capabilities, gaming devices having wireless communication capabilities, music storage and playback appliances having wireless communication capabilities, Internet appliances permitting wireless Internet access and browsing, as well as portable units or terminals that incorporate combinations of such functions.

There are several computer readable memories 14, 43, 45, 47, 48 illustrated there, which may be of any type suitable to the local technical environment and may be implemented using any suitable data storage technology, such as semiconductor based memory devices, flash memory, magnetic memory devices and systems, optical memory devices and systems, fixed memory and removable memory. The digital processor 12 may be of any type suitable to the local technical environment, and may include one or more of general purpose computers, special purpose computers, microprocessors, digital signal processors (DSPs) and processors based on a multicore processor architecture, as non-limiting examples.

For completeness further detail of an example UE is shown in both plan view (left) and sectional view (right) at FIG. 8. The UE 10 has a graphical display interface 20 and a user interface 22 illustrated as a keypad but understood as also encompassing touch-screen technology at the graphical display interface 20 and voice-recognition technology received at the microphone 24. A power actuator 26 controls the device being turned on and off by the user. The example UE 10 may have a camera 28 controlled by a shutter actuator 30 and optionally by a zoom actuator 32 which may alternatively function as a volume adjustment for the speaker(s) 34 when the camera 28 is not in an active mode.

Also shown is an image or video processor 44, a separate audio processor 46, and speakers 34. The graphical display interface 20 is refreshed from a frame memory 48 as controlled by a user interface chip 50 which may process signals to and from the display interface 20 and/or additionally process user inputs from the user interface 22 and elsewhere.

Within the sectional view of FIG. 8 are seen multiple antennas 36 which may be transmit only, receive only or both transmit and receive antennas that are typically used for cellular and/or non-cellular communication or wireless connectivity and which may be implemented by any of the various the example embodiments shown at FIGS. 1-7 and detailed above. Though two antennas are shown at 38, this is to encompass the multi-resonator embodiments and does not exclude the single tunable resonator embodiment described with reference to FIG. 1. In an embodiment the feed port 122 couples to the radio (radio-frequency RF) chip 38 that may include a receiver, or a transmitter, or both transmitter and receiver, or multiple incidences of either/both receiver and transmitter.

The operable ground plane to which is coupled the ground ports 106, 126, 128 is shown by shading as spanning the entire space enclosed by the UE housing though in some example embodiments the ground plane may be limited to a smaller area or a combination of areas and/or a combination of components, modules, mechanical parts, as not limiting examples, which may form the overall RF ground plane. The ground plane for the multiband antenna according to these teachings may be common with the ground plane used for additional prior art antennas disposed within the UE 10. The ground plane may be disposed on one or more layers of one or more printed wiring boards within the UE 10, and/or alternatively or additionally the ground plane may be formed from a solid conductive material such as a shield or protective case or it may be formed from printed, etched, moulded, or any other method of providing a conductive sheet in two or three dimensions. The signals received at the resonators are amplified by the power chip 38 and output to the RF chip 40 which demodulates and downconverts the various signals for baseband processing. The baseband (BB) chip 42 detects the signal which is then converted to a bit-stream and finally decoded. Similar processing occurs in reverse for signals generated in the apparatus 10 and transmitted from it.

There may be one or more secondary radios (Bluetooth or WLAN shown together as 42 but which may be RFID, GPS, and/or FM in other embodiments) which may or may not use embodiments of the invention. That is, a single host device such as the UE 10 may include multiple instances of the multiband antenna according to these teachings. Specific separate antennas for those secondary radios are not individually shown at FIG. 8 but understood from previous description.

Throughout the apparatus are various memories such as random access memory RAM 43, read only memory ROM 45, and in some example embodiments removable memory such as the illustrated memory card 47 on which various programs of computer readable instructions are stored. Such stored software programs may for example set the capacitance or inductance of the variable reactance 108 for those embodiments in which the resonance of the resonator changes in correspondence with the variable reactance setting, and in correspondence with transmit and/or receive schedules of the relevant radios. All of these components within the UE 10 are normally powered by a portable power supply such as a battery 49.

The aforesaid processors 38, 40, 42, 44, 46, 50, if embodied as separate entities in a UE 10, may operate in a slave relationship to the main processor 12, which may then be in a master relationship to them. Any or all of these various processors of FIG. 8 access one or more of the various memories, which may be on-chip with the processor or separate therefrom.

Note that the various chips (e.g., 38, 40, 42, etc.) that were described above may be combined into a fewer number than described and, in a most compact case, may all be embodied physically within a single chip.

Figure 9:
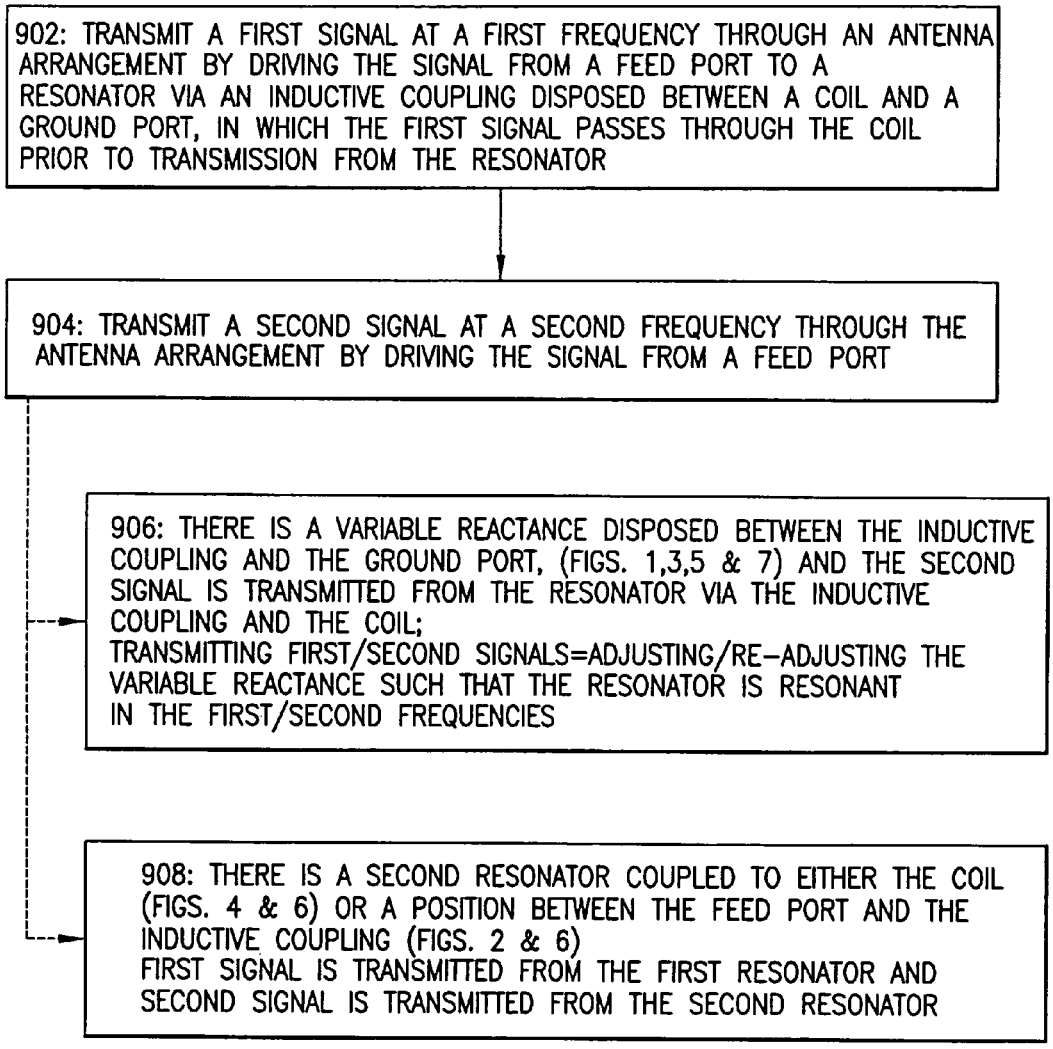
FIG. 9 is a logic flow diagram that illustrates the operation of a method, and a result of execution of computer program instructions embodied on a computer readable memory, in accordance with an example embodiment of the invention.

FIG. 9 is a logic flow diagram that illustrates the operation of a method for operating an electronic apparatus which embodies a multiband antenna structure according to these teachings. As seen at FIG. 9, at block 902 there is transmitted through an antenna arrangement a first signal at a first frequency. This transmission is done by driving the signal from a feed port 122 to a resonator 102 via an inductive coupling 124 disposed between a coil 104 and a ground port 106, in which the first signal passes through the coil 104 prior to transmission from the resonator 102 (or transmission from the coil/resonator pair if the coil forms a portion of the overall radio-frequency transmission member). Further in FIG. 9, at block 904 there is transmitted a second signal at a second frequency through the antenna arrangement by driving the signal from the feed port 122.

Blocks 906 and 908 of FIG. 9 are optional and detail different ones of the various specific but non-limiting embodiments described above. At block 906 the resonator 102 is tunable, and so the antenna arrangement 100 & 120 further comprises a variable reactance 108 disposed between the inductive coupling 124 and the ground port 106, and the second signal is transmitted from the resonator 102 via the inductive coupling 124 and the coil 104. In this block 906 embodiment, transmitting the first signal comprises adjusting the variable reactance 108 such that the resonator 102 is resonant in the first frequency and transmitting the second signal comprises re-adjusting the variable reactance 108 such that the resonator 102 is resonant in the second frequency.

At block 908 any tunable capability of the resonator is not used and so reference numbers refer to FIGS. 2 and 4. At block 908 there is a first resonator 202, 402 and a second resonator 210, 412 coupled to either the coil (412) or a position (seen for resonator 210) between the feed port 122 and the inductive coupling 124. In the block 908 embodiment, the first signal is transmitted from the first resonator 202 and the second signal is transmitted from the second resonator 210, 412.

The various blocks shown in FIG. 9 may be viewed as method steps, and/or as operations that result from operation of computer program code, and/or as a plurality of coupled logic circuit elements constructed to carry out the associated function(s).

In general, the various example embodiments may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the example embodiments of this invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

It should thus be appreciated that at least some aspects of the example embodiments of the inventions may be practiced in various components such as integrated circuit chips and modules, and that the example embodiments of this invention may be realized in an apparatus that is embodied as an integrated circuit. The integrated circuit, or circuits, may comprise circuitry (as well as possibly firmware) for embodying at least one or more of a data processor or data processors, a digital signal processor or processors, baseband circuitry and radio frequency circuitry that are configurable so as to operate in accordance with the example embodiments of this invention.

Various modifications and adaptations to the foregoing example embodiments of this invention may become apparent to those skilled in the relevant arts in view of the foregoing description, when read in conjunction with the accompanying drawings. However, any and all modifications will still fall within the scope of the non-limiting and example embodiments of this invention.

It should be noted that the terms "connected," "coupled," or any variant thereof, mean any connection or coupling, either direct or indirect, between two or more elements, and may encompass the presence of one or more intermediate elements between two elements that are "connected" or "coupled" together. The coupling or connection between the elements can be physical, logical, or a combination thereof. As employed herein two elements may be considered to be "connected" or "coupled" together by the use of one or more wires, cables and/or printed electrical connections. Where coupling is not physical as in inductive coupling, such is so stated herein.

Furthermore, some of the features of the various non-limiting and example embodiments of this invention may be used to advantage without the corresponding use of other features.

As such, the foregoing description should be considered as merely illustrative of the principles, teachings and example embodiments of this invention, and not in limitation thereof.

I claim:

1. An apparatus comprising multiband antenna circuitry and feed circuitry;

in which the multiband antenna circuitry comprises:

a resonator;

a first ground port configured to couple the resonator to a common voltage potential; and at least one reactive component disposed between the resonator and the first ground port;

and the feed circuitry comprises:

a signal feed port configured to couple to a radio;

a second ground port configured to couple the feed circuitry to the common voltage potential; and a feeding element disposed between the feed port and the second ground port, the feeding element configured to inductively couple the feed circuitry to the antenna circuitry between the resonator and the first ground port.

2. The apparatus according to claim 1, in which the feed circuitry further comprises a third ground port configured to couple the feed circuitry to the common voltage potential, in which the signal feed port is disposed between the feeding element and the third ground port.

3. The apparatus according to claim 1, in which the feeding element is configured to inductively couple the feed circuitry to the antenna circuitry between the reactive component and the first ground port.

4. The apparatus according to claim 1, in which the at least one reactive component comprises a coil.

5. The apparatus according to claim 1, in which the multiband antenna circuitry further comprises a variable reactance disposed between the at least one reactive component and the first ground port, the variable reactance comprising at least one of a variable capacitor and a variable inductor configured to tune a resonance of the resonator.

6. The apparatus according to claim 5, in which the said resonator is a first resonator and the multiband antenna circuitry further comprises a second resonator of fixed resonance coupled to the at least one reactive component.

7. The apparatus according to claim 5, in which the said resonator is a first resonator and the multiband antenna circuitry further comprises a second resonator of fixed resonance coupled to the feed circuitry between the feeding element and the signal feed port.

8. The apparatus according to claim 7, the multiband antenna circuitry further comprising a third resonator of fixed resonance coupled to the at least one reactive component.

9. The apparatus according to claim 5, in which the said resonator is a first resonator and the multiband antenna circuitry further comprises a second resonator, and in which each of the first resonator and the second resonator are planar.

10. The apparatus according to claim 1, in which the said resonator is a first resonator of fixed resonance and the multiband antenna circuitry further comprises a second resonator.

11. The apparatus according to claim 10, in which the second resonator is of fixed resonance and is coupled to the at least one reactive component.

12. The apparatus according to claim 10, in which the second resonator is of fixed resonance and is coupled to the feed circuitry between the feeding element and the signal feed port.

13. The apparatus according to claim 12, the multiband antenna circuitry further comprising a third resonator of fixed resonance coupled to the at least one reactive component.

14. The apparatus according to claim 10, in which each of the first resonator and the second resonator are planar.

15. A method comprising:

transmitting a first signal at a first frequency through an antenna arrangement by driving the signal from a feed port to a resonator via an inductive coupling disposed between a coil and a ground port, in which the first signal passes through the coil prior to transmission from the resonator; and transmitting a second signal at a second frequency through the antenna arrangement by driving the signal from the feed port.

16. The method according to claim 15, wherein the antenna arrangement further comprises a variable reactance disposed between the inductive coupling and the ground port, and the second signal is transmitted from the resonator via the inductive coupling and the coil;

in which transmitting the first signal comprises adjusting the variable reactance such that the resonator is resonant in the first frequency;

and transmitting the second signal comprises re-adjusting the variable reactance such that the resonator is resonant in the second frequency.

17. The method according to claim 15, wherein the said resonator comprises a first resonator and the antenna arrangement further comprises a second resonator coupled to either the coil or a position between the feed port and the inductive coupling;

in which the first signal is transmitted from the first resonator and the second signal is transmitted from the second resonator.

18. A portable electronic device comprising the apparatus according to claim 1.

* * * * *